United States Patent [19]

Shimizu et al.

[11] 4,416,616

[45] Nov. 22, 1983

[54] WICK FOR BURNING LIQUID FUEL

[75] Inventors: Hideharu Shimizu, Yamatokoriyama; Akihiko Hashimoto, Nara, both of Japan

[73] Assignee: Matsushita Electric Industrial Co., Ltd., Osaka, Japan

[21] Appl. No.: 308,138

[22] Filed: Oct. 2, 1981

[30] Foreign Application Priority Data

Oct. 2, 1980 [JP] Japan ..... 55-138548

[51] Int. Cl.[3] ..... F23D 3/18; F24C 5/04

[52] U.S. Cl. ..... 431/325; 431/324; 126/96

[58] Field of Search ..... 126/45, 96; 431/302, 431/324, 325

[56] References Cited

FOREIGN PATENT DOCUMENTS

| | | | |
|---|---|---|---|
| 52-52238 | 4/1977 | Japan | 431/325 |
| 52-58134 | 5/1977 | Japan | 431/325 |
| 845639 | 8/1970 | United Kingdom | 431/325 |

*Primary Examiner*—Samuel Scott
*Assistant Examiner*—G. Anderson
*Attorney, Agent, or Firm*—Stevens, Davis, Miller & Mosher

[57] ABSTRACT

A wick for burning a liquid fuel, having a liquid fuel supplying section adapted to supply the liquid fuel and a combustion section connected to the upper end of the liquid fuel supplying section and adapted to evaporate the liquid fuel supplied through the liquid fuel supplying section thereby to burn the liquid fuel. The improvement comprises that a thin sheet body from heat resistance fibers is attached at least to a part of the combustion section and that the combustion section is separably coupled to the liquid fuel supplying section. The thin sheet body attached to the combustion section reduces the generation of tar on the latter, while the separable coupling between the liquid fuel supplying section and the combustion section permits an easy renewal of the combustion section solely when the tar deposition on the latter has become heavy.

3 Claims, 14 Drawing Figures

WICK FOR BURNING LIQUID FUEL

BACKGROUND OF THE INVENTION

The present invention relates to a wick for burning a liquid fuel.

The wicks for burning a liquid fuel used in liquid fuel burning equipment such as kerosene stoves have a flame forming portion made of a fabric knitted or woven from a mixture of yarns mainly consisting of glass fibers mix-spun with staple fibers or the like. The glass fibers used in these conventional wicks have diameters as large as around 9μ. In these conventional wicks, the gaps between the yarn threads is considerably large because the wicks are made of knitted or woven fabric. In addition, the flammable content such as staple fibers is burnt when the wick is frequently used causing the gaps between adjacent glass fibers of each yarn thread to further increase. Large gaps between the adjacent yarns and between the adjacent glass fibers make, in combination with the large diameters of the glass fibers, the size of capillary gaps formed in the wick considerably large. In consequence, the capillary action of the wick is very much reduced. This means that as the height of the wick portion above the surface of the liquid fuel such as kerosene becomes higher, the amount of the liquid fuel in the upper end portion of the wick is decreased. Therefore, when an inferior kerosene is used as the fuel, the temperature of the combustion section of the wick is inconveniently increased to permit formation of tar.

In addition, since the combustion section and the fuel capillary supply section of the wick are formed integrally, a series of troublesome work such as demounting of heat shielding plate, wick cover sleeve and other parts is required for renewing the wick when the latter has become unusable due to generation of tar due to the use of a fuel of inferior quality. The conventional wicks impose also a problem of high maintenance costs on the user because the whole part of the wick including still unburnt fuel capillary supply portion has to be renewed when the wick has become unusable.

SUMMARY OF THE INVENTION

Accordingly, an object of the invention is to provide a wick for burning liquid fuels, capable of preventing the formation of tar due to the use of inferior quality liquid fuel or a fuel in which different quality liquid fuels are mixed, thereby to overcome the problems which may occur as a result of formation of tar.

Another object of the invention is to provide a wick for burning liquid fuels which can be renewed, when the wick has become unusable due to deposition of tar, without requiring any specific skill and at a low cost.

To these ends, according to the invention, there is provided a wick for burning liquid fuels comprising: a liquid fuel capillary supply section for supplying a liquid fuel; a flame forming portion provided on the liquid fuel supplying section and adapted to evaporate the supplied liquid fuel; a shin sheet body made of heat resistant fibers attached to at least a portion of the flame forming portion; and means for detachably connecting the combustion section to the liquid fuel supplying section.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
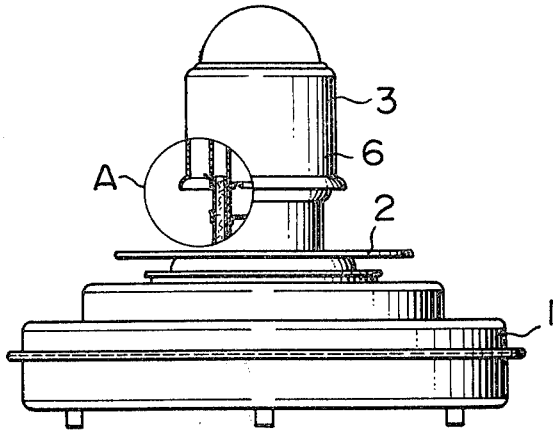
FIG. 1 is a front elevational view of a kerosene stove incorporating a wick in accordance with the present invention, with an essential part thereof being shown in section.
Figure 2:
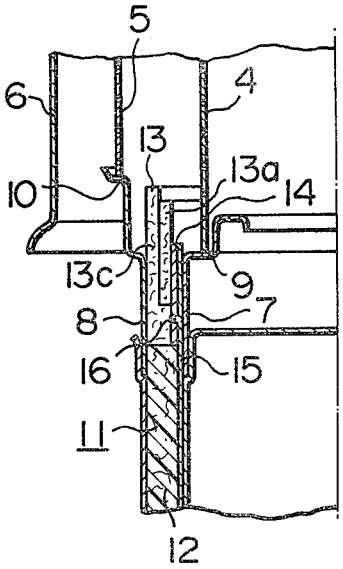
FIG. 2 is an enlarged sectional view of an essential part of the stove shown in FIG. 1.

Referring first to FIG. 1 showing a kerosene stove incorporating a wick of the invention, a combustion cylinder 3 is disposed above a heat shielding plate 2 which is situated on a fuel tank 1. The portion of the stove encircled by a circle A in FIG. 1 is shown in FIG. 2 in more detail. As will be clearly understood from this Figure, the combustion cylinder has an inner and outer cylindrical flame sleeves 4 and 5. The outer flame sleeve 5 is surrounded by an outer sleeve 6. The inner and outer flame sleeves 4 and 5 are supported at their lower ends by flat annular shoulders 9 and 10 of inner and outer wick guide sleeves 7 and 8. A cylindrical wick 11 has, as will be seen from FIG. 5, a liquid fuel supplying section 12 disposed between the inner and outer guide sleeves 9 and 10 and a combustion section 13 connected to the upper end portion of the supplying section 12.

The supplying section 12 is made of a fabric woven from fibers such as cotton, staple fiber or hydrophobic chemical synthetic fibers having good affinity to liquid fuel such as polypropylene fibers. The upper end portion of the supplying section is made rigid by a starch bond or bound by a stiff tape at its outer peripheral surface for reinforcement.

Figure 5:
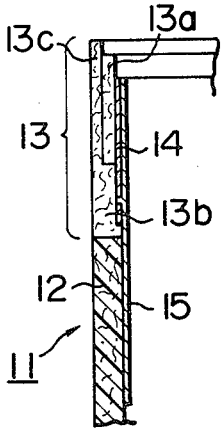
FIG. 5 is a sectional view of an essential part.

As will be seen from FIG. 5, the combustion section 13 has a cylindrical main portion knitted or woven mainly from glass fibers to have a thick lower part 13*b* and a thin upper part 13*c*, and a thin sheet body 13*a* attached to the inner peripheral surface of the thinner upper part 13*c* of the main portion. The thin sheet body 13*a* is formed from heat-resistant fibers such as ceramic fibers into a paper-like body and is shaped by means of a suitable amount of an organic binder such as polyvinyl acetate. The thin sheet body 13*a* is jointed to the inner peripheral surface of the upper part 13*c* by sewing such that the top end of the thin sheet body 13*a* is positioned slightly below the top end of the thinner upper part of the main body 13*c*. The lower end of the thin sheet body 13*a* takes a position just above the lower part 13*b*. The knitted or weaving of the main cylindrical portion of the wick having the thinner upper part 13*c* and the thicker lower part 13*b* can easily be formed by means of a Raschel loom of weft insertion type. If this type of machine is not available, the main cylindrical portion may be formed by jointing two knotted or woven fabrics having different web widths.

Figure 3:
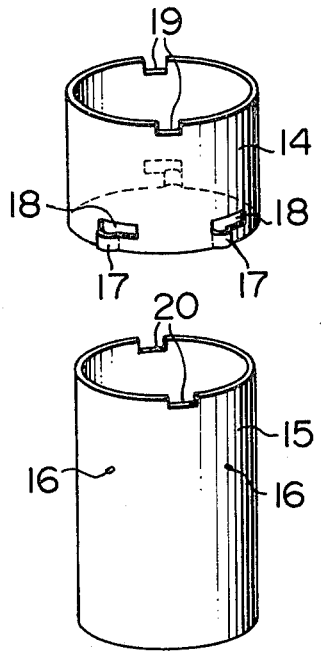
FIGS. 3 and 4 are exploaded perspective views of essential parts of the stove shown in FIG. 1.
Figure 4:
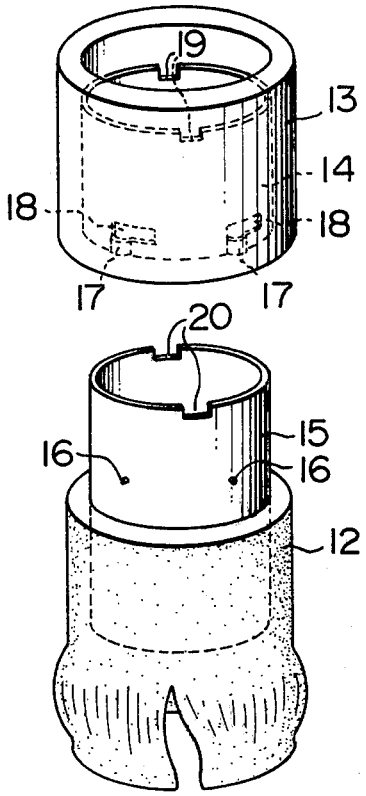

Referring again to FIG. 2, a wick coupling member 14 having a generally cylindrical form is fixed to the inner peripheral surface of the combustion section 13, while another wick coupling member 15 also having a cylindrical form is fixed to the inner peripheral surface of the supply section 12 of the wick. More specifically, these wick coupling members 14 and 15 have cylindrical forms as shown in FIG. 3, and are secured to the wick 11 in a manner shown in FIGS. 4 and 5. These wick coupling members 14 and 15 are detachably integrated with each other by a bayonet coupling or by means of screws.

An explanation will be made hereinunder as to how these wick coupling members 14 and 15 are connected to each other, with refering to FIG. 3. Projections 16 are formed on a part of the outer peripheral surface of the coupling member 15 at an upper portion of the latter. On the other hand, the coupling member 14 is provided at its lower end with outward protrusions 17 which define recesses joined to elongated holes 18 formed in the lower portion of the wick coupling member 14 to extend in the circumferential direction. In coupling both coupling members 14 and 15 to each other, the projections 16 are made to pass through the recesses of the protrusions 17 into the elongated holes 18. In this state, as will be seen from FIG. 6, the upper edges of the coupling members 14 and 15 are flush with each other. The coupling members 14 and 15 are provided at their upper edges notches 19 and 20 as illustrated. More specifically, the notch 20 of the coupling member 15 has a larger horizontal length than the notch 19 formed in the coupling member 14. As will be seen from FIG. 3, the notches are formed to diametrically oppose each other in each coupling members 14 and 15.

Figure 6:
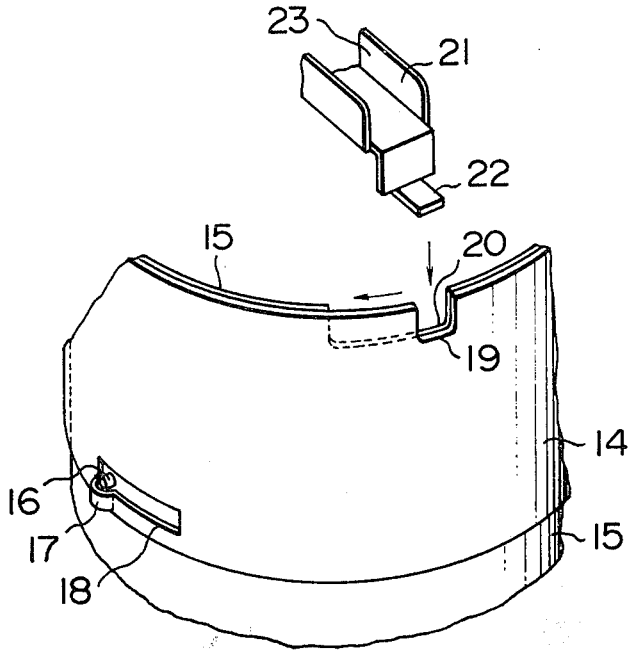
FIGS. 6 and 7 are perspective views showing the manner of attaching jigs for connecting and disconnecting wick coupling members to and from each other.

Referring now to FIG. 6, a reference numeral 21 designates a jig provided at its upper end with a retaining portion 22 for engaging the notch 19 and a central handle 23. As the jig 21 is gripped at the handle 23 and rotated, the coupling member 14 is rotated relatively to the coupling member 15 with the retaining member 22 guided by the notch 20. As a result of this rotation, the projections 16 are moved into corresponding elongated holes 18 to complete a bayonet coupling between two coupling members. As in the case of ordinary bayonet coupling, the two wick coupling members 14 and 15 are separated from each other in a reverse procedure.

Another preferred method of connecting the wick coupling members is as follows. The wick coupling members 14 and 15 are provided with screw threads engageable with each other, so as to be coupled to each other by screwing as the wick coupling member 14 is rotated relatively to the wick coupling member 15 by means of the above-explained jig 21. The separation of the members 14, 15 from each other is made by unscrewing them from each other.

Figure 7:
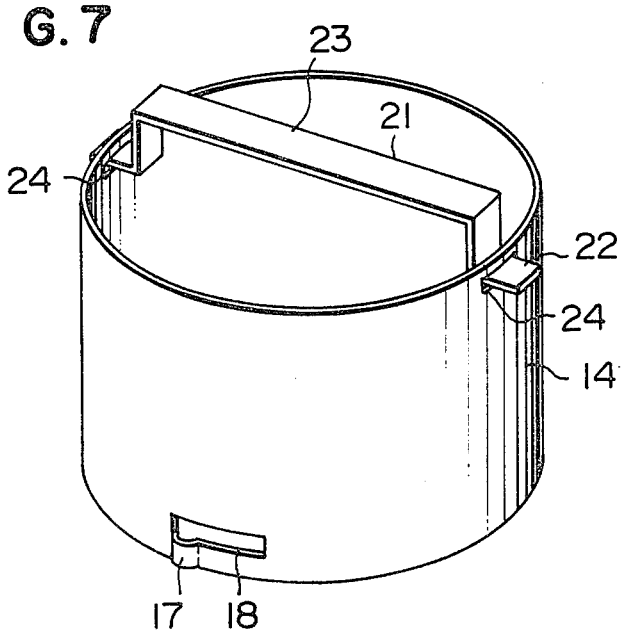

In an arrangement shown in FIG. 7, the wick coupling member 14 is provided with two diametrically opposing through holes 24 adapted to receive the retaining portions 22 of the jig 21, to permit an easy rotation of the wick coupling member 14 by the jig 21 to facilitate the bayonet coupling or screwing coupling of two wick coupling members 14, 15. Although in the described embodiment, the wick coupling member 14 is rotated relatively to the wick coupling member 15, this is not exclusive and the bayonet coupling or screwing coupling may be achieved by rotating the member 15 while keeping the member 14 stationary.

Figure 8:
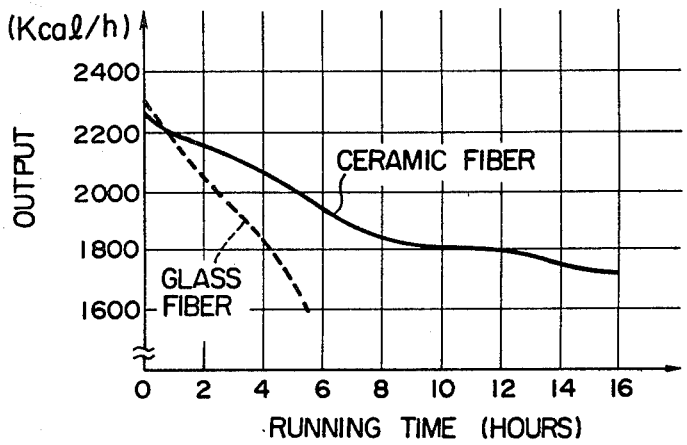
FIG. 8 is a graphical representation of effect in durability of a wick using a liquid fuel having an inferior quality.

In the wick of the invention having the described construction, the combustion section 13 has a thin sheet body 13*a* consisting of ceramic fibers of diameters smaller than 4μ. In consequence, the fuel holding capacity of the combustion section 13 is increased remarkably to exhibit a much superior durability to conventional wicks consisting of glass fibers when inferior quality fuel is used as shown in FIG. 8. This is attributable to the following reasons. First of all, it is to be appreciated that the fibers of the flame forming portion 13 have diameters below 4μ which is less than a half of those of glass fibers used in the conventional wicks. In addition, since these fibers are formed into a paper-like body in a process similar to known paper-making process, long continuous and minute capillary passageways are formed uniformly without substantial discontinuity so that sufficient capillary action head or height can be maintained utilizing the effect of capillary action to maintain a substantially constant amount of fuel held in the combustion section 13 of the wick. This superiority of the invention will be realized also from FIG. 9.

Figure 9:
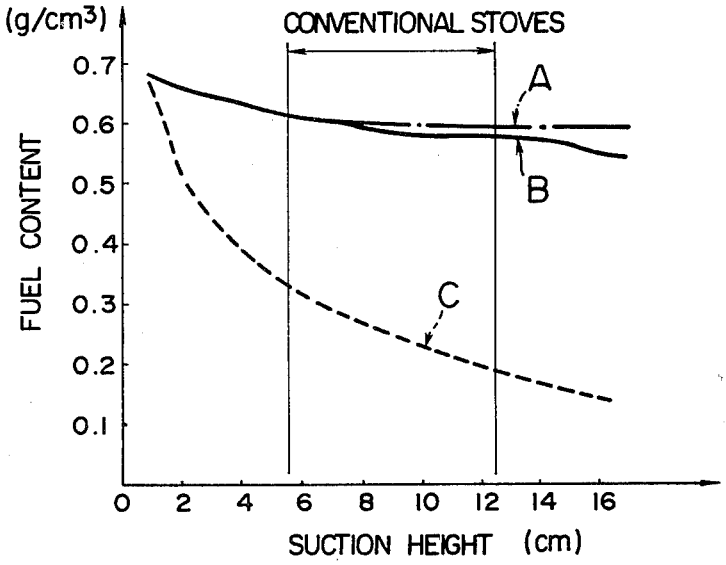
FIG. 9 is a graphical representation of a relationship between the supply height and the fuel content in the wick.

Namely, referring to FIG. 9, a curve A shows the characteristics of a thin sheet body shaped to have a paper-like form from glass fibers of diameters ranging between 0.5 and 1μ, while a curve B shows the characteristics of a thin sheet body shaped to have a paper-like form from ceramic fibers of diameters ranging between 2.5 and 3.5μ. Finally, the curve C shows the characteristics of a fabric woven from 75% of glass fibers of diameters around 9μ and 25% of staple fibers.

In the cases of the curves A and B, the temperature at the end of the combustion section 13 is less liable to rise because this portion contains a sufficient amount of fuel, so that the generation of tar is not so heavy. In addition, the capillary passageways are minute and are filled with the liquid fuel almost fully, so that no substantial generation of tar takes place in the capillary passageways. Although there may be a slight formation of tar on the surface of the combustion section 13, such tar can completely be burnt away and removed by a dry burning (burning with little residual fuel until the latter is depleted). These favorable characteristics were commonly observed with the thin sheet body consisting of fibers of diameters smaller than 4μ. It was confirmed also that the characteristic curve approaches that represented by the curve C in FIG. 9, i.e. to the characteristics of the combustion section made from glass cloth, as the diameter of the fibers is increased beyond 4μ. This can be attributable to the following reasons.

Namely, the capillary action which is closely related to the fuel holding capacity of the wick is determined by the balance between the surface tension δ and the force of gravity as expressed by the following equation:

$$2\pi r\delta = \pi r^2 hdg$$

where, r represents the radius of the capillary tube, h represents the height of the liquid column, d represents the density of the liquid and g represents the gravity acceleration.

The following equation is derived from the above equation:

$h=(2\delta/rdg)$

Thus, the liquid supply head, i.e. the height of the column of the supply liquid is in inverse proportion to the size of the capillary passageways, i.e. to the diameter of the fibers. It is considered that, as the fiber diameter is increased beyond 4μ, the liquid height or head h is decreased so as to adversely affect the fuel holding capacity, but the fiber diameters below 4μ does not substantially affect the capillary action head h of ordinary liquid fuel burning equipment.

It seems that the fuel supply characteristics are substantially not varied by the types of fibers such as glass fibers, rock wool, ceramic fibers and so forth used, provided that the fiber diameters are the same. It is to be noted, however, that the fiber diameter may be reduced, however, it is density (bulk specific weight) of the wick is reduced excessively, the fuel holding capacity is undersirably decreased because the diameters of the capillary passageways will be increased.

For instance, a combustion section 13 formed from ceramic fibers of 2.6 to 3μ dia. and of a specific weight of 2.6 g/cm$^3$ exhibits the characteristics which tends to approach that shown by the curve C in FIG. 9, when the combustion section is shaped to have a bulk specific weight of less than 0.25 g/cm$^3$. This means that the voidage or space factor of the thin sheet body 13*a* shaped in a paper-like form from heat resistant fibers should not be increased beyond 90%.

The reduced fiber diameter imposes another problem of reduced heat resistance, because the fibers of reduced diameter tend to be heated to higher temperature.

For instance, repeated dry burning operations effected 10 times on the combustion section 13 formed from glass fibers of diameters around 9μ does not cause any damage, although the ends of the glass fibers are slightly rounded. However, the combustion section 13 formed from glass fibers of diameters around 3μ cannot withstand even one dry burning operation. Namely, the glass fibers are melted to make the wick unusable.

The temperature during the dry burning will reach 800° C. It is, therefore, preferred that the fiber material can withstand this temperature. To comply with this demand, ceramic fibers which are now widely available commercially are preferably used. The ceramic fibers generally can withstand temperatures as high as 1000° C. or higher. In fact, no melting of the fibers was observed at the end of the wick even after a number of repeated dry burning operations. Considering that the cost of ceramic fibers has been decreasing recently thanks to the establishment of techniques for mass production, ceramic fibers are the most suitable material for this purpose.

Rock wool is said to withstand a temperature of 600° C. A series of test was conducted with a wick made from rock wools with fiber diameters between 2 and 4μ. No substantial melting down of fibers was observed after 10 repeated dry burning operations. This means that the rock fibers are also usable as the material of the wick of the invention.

The supply characteristics are generally improved as the fiber diameter is reduced. Thus thin sheet body 13*a* of the wick of the invention, formed as a thick paper from heat resistant fibers of diameters less than 4μ, showed a superior supply characteristics even when the height of the wick from the level of the liquid fuel is high.

A problem of the pricking of a user's hand by the fibers during renewal of the wick is often experienced when the fiber diameter is greater than 5μ. This pricking problem is also found by a worker who handles the wick in the production process thereof. The wick of the invention is free from this problem because it incorporates fibers of diameters smaller than 4μ. Thus, the wick of the invention can easily be produced using ceramic fibers of diameters ranging between 2 and 3.5μ which are now commercially available.

In the described embodiment of the invention, since the combustion section 13 and the supply section 12 are coupled to each other detachably, the wick can be renewed in a very simple manner and at a reduced cost as compared with conventional wicks.

It is undeniable that the formation of tar cannot be perfectly eliminated however the durability of the wick when inferior fuel is used may be improved. Thus, it is required that the durability of the wick when inferior fuel is used should be improved and also that, when the deposition of tar has become appreciable, the wick can be renewed without substantial difficulty.

To this end, the following consideration is made in achieving the present invention.

If the invention was aimed solely at improving the durability of the wick against the use of deteriorated fuel, the greatest effect would be obtained by constructing the whole part of the combustion section 13 with the paper-like thin sheet body 13*a*. Such an arrangement, however, imposes the following problem. The supply section 12 has to have a sufficient stiffness at its upper end portion for contacting the combustion section 13, because it is required to stand repeated use. For coupling the thin sheet body 13*a* shaped in a comparatively stiff paper-like form to the stiff upper end portion of the supply section 12, the force for connecting the two wick coupling members 14 and 15 should be very large so that the connection therebetween is made sufficiently rigid. Such a rigid connection, however, makes the connection and disconnection rather difficult. To avoid this problem, according to the invention, the lower end part 13*b* of the combustion section 13 is composed of knitted or woven fabric which is very flexible but not so stiff.

The thin sheet body shaped into the form of a paper generally exhibits a reduced tensile strength. In order to compensate for the reduction of the tensile strength, according to the invention, the thin sheet body 13*a* is superposed to the upper part 13*c* of the combustion section 13 made from the knitted or woven fabric. Namely, in the wick which permits the renewal of the combustion section 13 solely, it may become necessary to grip the end of the combustion section 13 and to pull out the same after the disconnection of the coupling members 14 and 15 from each other. From this point of view, the combustion section 13 should have a sufficiently high tensile strength.

The wrapping of the paper-like thin sheet body 13*a* by the upper part 13*c* consisting of knitted or woven fabric is effective also in preventing flame blowback due to a contraction of the combustion section 13.

Namely, as the burning of the fuel is deteriorated as a result of deposition of tar content due to the use of a liquid fuel of inferior quality, the temperature of the combustion section 13 becomes higher to cause a contraction at the end of the combustion section 13 resulting in a turning inward falling of the same end. This contraction of the thin sheet body can be avoided almost perfectly by treating the same by an inorganic binder such as colloidal silica. Unfortunately, however, there is no effective measure for preventing the contraction of the combustion section 13 made from the knitted or woven fabric. Therefore, if the upper part 13*c* of the combustion section 13 is placed at the inner side of the plate member 13, it exhibits a contraction to cause an inward inclination to be made, in the worst case, contact with the inner flame sleeve 4. In such a case, if the ventilation hole is located at a level below the point of the contact between the upper part 13*c* of the combustion section 13 and the inner flame sleeve 4, the vapor of the liquid fuel will dangerously flow back into the inner flame sleeve 4 and catch fire to cause a phenomenon called blowback. To avoid such a danger, according to the invention, the upper part 13*c* of the combustion section 13 formed from the knitted or woven fabric is placed at the outer side of the thin sheet body 13*a*.

According to the invention, as stated before, the top end of the upper part 13*c* of the combustion section 13 is made to project slightly above the top end of the thin sheet body 13*a*, in order to achieve a higher propagation speed of the flame to suppress the generation of an offensive smell at the time of lighting the wick. Namely, since the fuel content of the upper part 13*c* is comparatively small to create a state of dry burning during the use of the burning equipment, no substantial deposition of tar is formed on the projected portion to permit a rapid propagation of flame at the time of lighting while suppressing the release of the offensive smell.

Figure 10:
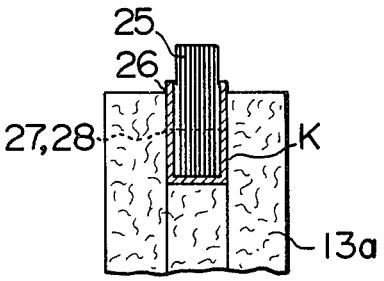
FIG. 10 is a sectional view of a thin sheet body provided with a belt-like auxiliary wick.
Figure 11A:
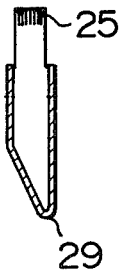
FIGS. 11*a*, 11*b* and 11*c* are sectional views of a belt-like auxiliary wick having fuel adjusting means.
Figure 11B:
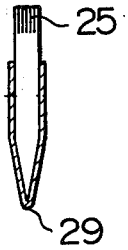
Figure 11C:
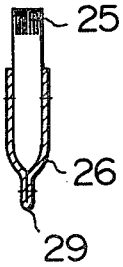
Figure 11D:
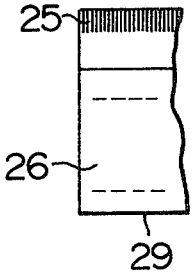
FIG. 11*d* is a front elevational view of the structure shown in FIG. 11*c*.

FIG. 10 shows another embodiment which is intended for achieving a rapid propagation of the flame.

In this embodiment, an auxiliary wick 25 is removably received by a recess K formed in the top surface of the thin sheet body 10. The auxiliary wick 25 is made from a fabric consisting mainly of glass fibers. In order to facilitate the insertion of the recess, the lower end of the auxiliary wick 25 is stiffened by a starch adhesive or the like. This arrangement offers the following advantage. Namely, the propagation speed of the flame is gradually decreased as a result of repeated use. However, in this embodiment, the high flame propagation speed is recoverable simple by a replacement of the auxiliary wick with a spare one which is much cheaper.

FIG. 11, as well as FIG. 10, shows still another embodiment in which an aluminum foil 26 as a means for adjusting the rate of supply of the fuel is interposed between the thin sheet body 13*a* and the belt-like auxiliary wick 25. According to this arrangement, the auxiliary wick 25 is maintained in the dry burning state during the use of the burning equipment to prevent the deposition of tar on the auxiliary wick thereby to prolong the life of the latter.

Namely, in this embodiment, the aluminum foil 26 is interposed between the contacting regions of the thin sheet body 13*a* and the auxiliary wick 25, and the aluminum foil 26 is sewed to the auxiliary wick 25 by means of a thread 28 thereby to form perforations 27. When the flame is extinguished after the use of the equipment, the auxiliary wick 25 is supplied with the liquid fuel through the perforations 27 until it is saturated with the liquid fuel, so that a higher flame propagation speed is obtained when the wick is lit again. However, during the use of the equipment, the auxiliary wick 25 is maintained substantially in the state of dry burning, because the rate of burning, i.e. the rate of consumption of the liquid fuel is greater than the rate of supply of the liquid fuel through the perforations 27 thereby to prevent the deposition of tar to ensure a rapid propagation of the flame over repeated use.

The auxiliary wick 25 may be fixed to the aluminum foil in various ways. In the illustrated embodiment, the fixing is made by sewing with thread 28, so that the small holes formed as a result of the sewing can serve as the perforations 27. This, however, is not exclusive and the fixing can be made by means of an adhesive or by means of short wires at a predetermined interval in the circumferential direction.

The use of the aluminum foil 26 offers various other advantages. For instance, the mechanical strength of the wick is increased, and the insertion of the belt-like auxiliary wick 25 into the thin sheet body 13*a* is facilitated considerably. The insertion into the recess K will be further facilitated by providing a taper 29 at the lower side of the auxiliary wick 25 as illustrated in FIG. 11. Other metal foils and materials having low permeability to liquid fuel, interposed between or applied to the regions of contact between the auxiliary wick 25 and the thin sheet body 13*a* can be used as the means for adjusting the rate of supply of the liquid fuel.

In order to make the full use of the advantage offered by the aluminum foil 26, the aluminum foil 26 preferably projects 0.5 to 1.5 mm from the upper end of the thin sheet body 13*a*, at the upper end portion of the region of contact between the thin sheet body 13*a* and the auxiliary wick 25.

As has been described, according to the invention, the combustion section of the wick can hold a sufficiently large amount of the liquid fuel so that the tendency of deposition of the tar is suppressed remarkably. In addition, even when a considerable deposition of the tar content is formed on the combustion section, the latter can easily be separated from the liquid fuel supply section and replaced with a new one, without requiring the renewal of the liquid fuel supply section which is a great advantage from an economic point of view.

What is claimed is:

1. A wick for burning a liquid fuel comprising:

a liquid fuel supplying section for supplying a liquid fuel; a combustion section having a lower part making detachable contact with said liquid fuel supplying section and adapted to evaporate said liquid fuel supplied through said liquid fuel supplying section, said combustion section comprising a thin sheet body consisting of ceramic fibers and a knitted or woven fabric consisting mainly of glass fibers, said fabric and sheet body being superposed on one another with the top end of said fabric projecting slightly above the top end of said thin sheet body, said lower part of said combustion section being formed of a knitted or woven fabric mainly consisting of glass fibers for detachably coupling said combustion section with said liquid fuel supplying section.

2. A wick for burning a liquid fuel as claimed in claim 1, wherein said ceramic fibers have diameters less than $4\mu$.

3. A wick for burning a liquid fuel as claimed in claim 1, wherein said fabric which is superposed with said thin sheet body is placed at the outer side of said thin sheet body.

* * * * *